US006569030B1

(12) United States Patent
Hamilton

(10) Patent No.: US 6,569,030 B1
(45) Date of Patent: May 27, 2003

(54) GOLF STROKE DEMONSTRATION ROBOT

(76) Inventor: David Paul Hamilton, P.O. Box 165, Shannon, MS (US) 38868

( * ) Notice: Subject to any disclaimer, the term of this patent is extended or adjusted under 35 U.S.C. 154(b) by 0 days.

(21) Appl. No.: 10/164,042

(22) Filed: Jun. 6, 2002

Related U.S. Application Data

(63) Continuation-in-part of application No. 10/101,087, filed on Mar. 19, 2002, now Pat. No. 6,561,920.

(51) Int. Cl.[7] ..... A63B 69/36
(52) U.S. Cl. ..... 473/257; 473/219; 434/252
(58) Field of Search ..... 473/257, 219, 473/258, 260, 261, 262, 270; 434/247, 252

(56) References Cited

U.S. PATENT DOCUMENTS

| | | | | | |
|---|---|---|---|---|---|
| ,731,825 | A | | 6/1903 | Voorhees | |
| 1,825,778 | A | | 10/1931 | Chester | |
| 2,513,198 | A | | 6/1950 | Munro | |
| 3,050,307 | A | * | 8/1962 | Glass et al. | 273/108.22 |
| 3,179,413 | A | | 4/1965 | Leclerc | |
| 3,190,653 | A | | 6/1965 | Karthaus | |
| 3,458,195 | A | * | 7/1969 | Neubeck | 273/108.22 |
| 3,503,613 | A | | 3/1970 | Caya | |
| 3,928,932 | A | * | 12/1975 | Maurer | 446/303 |
| 4,239,217 | A | * | 12/1980 | Thieme et al. | 273/108.22 |
| 4,279,419 | A | | 7/1981 | Barnes et al. | |
| 5,156,401 | A | | 10/1992 | Hodgkiss | |
| 5,449,171 | A | | 9/1995 | Makhoulian | |
| 5,795,238 | A | | 8/1998 | Nicholson | |
| 5,879,239 | A | | 3/1999 | Macroglou | |
| 5,947,742 | A | * | 9/1999 | Katayama | 434/247 |
| 6,071,202 | A | | 6/2000 | Densberger et al. | |
| 6,149,537 | A | | 11/2000 | Hooker | |
| 6,277,030 | B1 | * | 8/2001 | Baynton et al. | 473/219 |
| 2001/0027136 | A1 | | 10/2001 | Chris | |
| 2001/0041624 | A1 | | 11/2001 | Macroglou | |

* cited by examiner

*Primary Examiner*—Paul T. Sewell
*Assistant Examiner*—Nini F. Legesse
(74) *Attorney, Agent, or Firm*—John V. Stewart

(57) ABSTRACT

A mechanical human figure standing in a golf putting posture, having a lower stationary assembly of feet, legs, and spine, and having an upper pivoting assembly of shoulders and arms. The arms are fixed relative to the shoulders. A golf club is fixed to the lower ends of the arms in a golf putting grip. The upper assembly is attached to the spine on a pivot axle extending forward and upward from the top of the spine between the shoulders. The club head pivots in a circular swing arc tangent to the ground. A golf ball and a stroke guide are placed on the ground in front of the robot. Two laser sources on the pivoting assembly illuminate two aspects of a proper stroke on the ground and on the guide. The arms are lifted manually into a backswing and released, striking the ball and demonstrating the guide.

7 Claims, 5 Drawing Sheets

GOLF STROKE DEMONSTRATION ROBOT

CROSS-REFERENCE TO RELATED APPLICATIONS

This application is a continuation-in-part of the previous patent application of the same inventor titled "Golf Stroke Training Device and Method", Ser. No. 10/101,087, filed Mar. 19, 2002 now U.S. Pat. No. 6,561,920. The present invention is a mechanical human figure that demonstrates the device and method of the previous application.

BACKGROUND OF THE INVENTION

1. Field of the Invention

This invention relates to mechanical human figures with mobile parts that hold a golf club and demonstrate a golf stroke.

2. Description of Prior Art

Several prior patents show mechanical human figures with a torso that rotates at or above the hips on an axis approximately aligned with the lower spine of a corresponding human, or parallel to it. Prior patents also show golf stroke demonstration or training aids with laser illumination of the ball-target line.

The present robot differs from the prior devices in the following respects: None of the prior devices has a pivot axis that generates a swing circle of the club head centered between the shoulders of the robot. None of the prior devices use gravity to generate a putting stroke. This not only simplifies the mechanism, but also smoothes the stroke movement, producing consistently perfect demonstration putts. None of the prior devices provides a planar laser beam that illuminates the intersection of the plane of the club face with the ground to demonstrate ideal club face alignment. Thus, none of the prior devices can properly demonstrate the putting guide of the related patent application.

SUMMARY OF THE INVENTION

The objectives of the present invention are provision of a life-sized golf putting demonstration robot that mechanically demonstrates a perfect putting stroke using a putting stroke guide and method as shown in the related patent application noted above, and which strikes a golf ball with perfect accuracy every time.

The objectives of the present invention are achieved by a mechanical human figure standing in a golf putting posture, having a lower stationary assembly of feet, legs, and spine, and having an upper pivoting assembly of shoulders and arms. The arms are fixed relative to the shoulders. A golf club is fixed to the lower ends of the arms in a golf-putting grip. The upper assembly is attached to the spine on a pivot axle extending forward and upward from the top of the spine between the shoulders. The club head pivots in a circular swing arc tangent to the ground. A golf ball and a stroke guide are placed on the ground in front of the robot. Two laser sources on the pivoting assembly illuminate two aspects of a proper stroke on the ground and on the guide. The arms are lifted manually into a backswing and released, whereupon they fall in a pendulum motion by gravity, causing the club head to strike the ball, and demonstrating the guide.

REFERENCE NUMBERS

Figure 1:
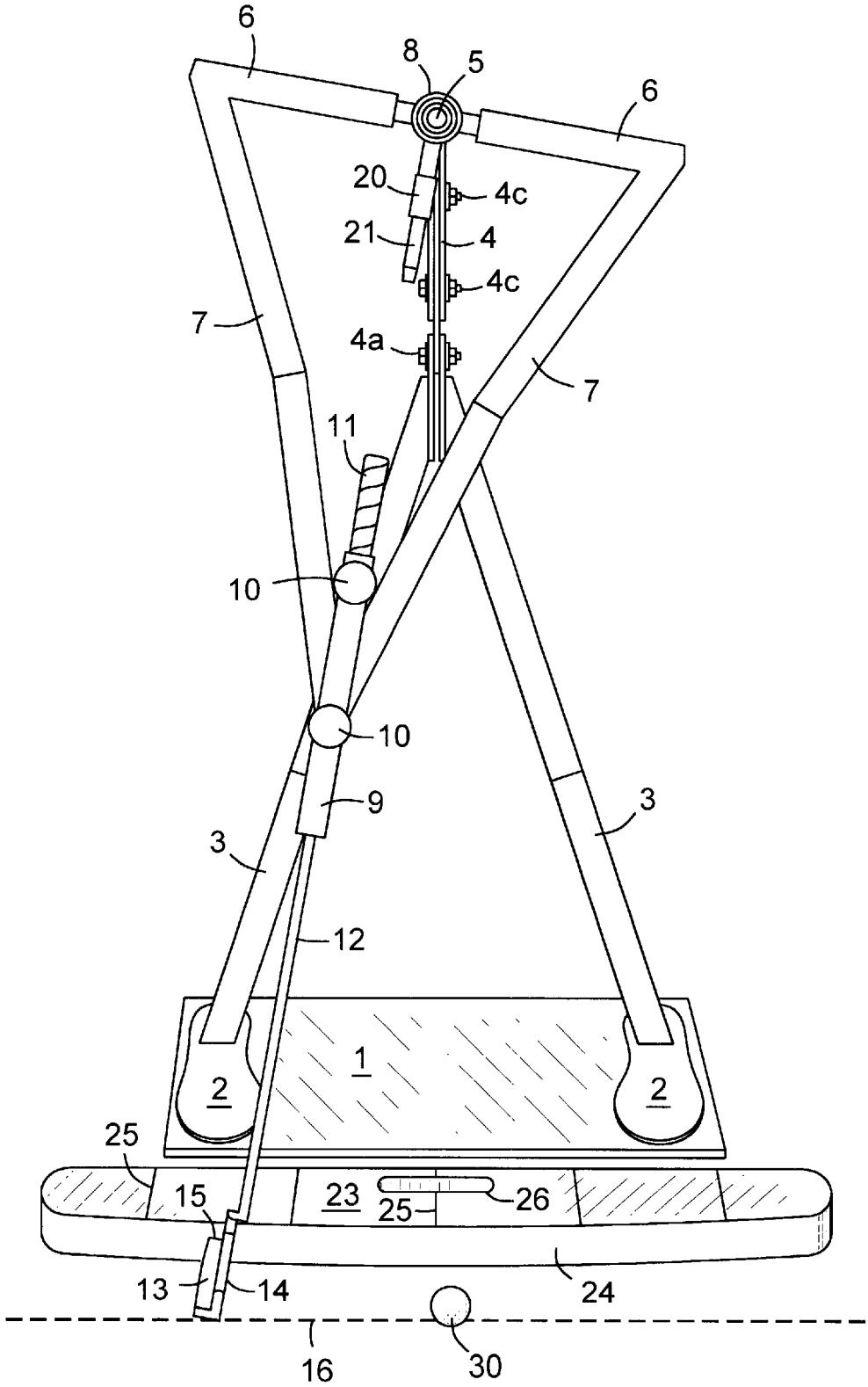
FIG. 1 is a front view of the robot in a putting backswing position.

1. Base
2. Foot
3. Leg
4. Spine
4*a*. Spine attachment and angle adjustment bolt
4*b*. Shaft attachment and angle adjustment bolt
4*c*. Spine length adjustment bolt
5. Pivot shaft
6. Shoulder
7. Arm
8. Pivot bearing assembly
8*a*. Bearing
9. Golf club holder
10. Golf club clamp screw knob
11. Golf club grip
12. Golf club shaft
13. Golf club head
14. Golf club face
15. Golf club heel
16. Laser illuminated ball-target line
17. Laser illuminated club face alignment line
18. First laser holder
19. Laser source for club face alignment line
20. Second laser holder
21. Laser source for ball-target line
23. Golf stroke guide
24. Vertical guide surface on guide
25. Club face alignment mark on guide
26. Carrying grip hole on guide
30. Golf ball
A. Axis of swing circle or arc
B. Horizontal distance from center of swing circle to ball.
H. Height of center of swing circle above the ground.
P. Swing plane.
R. Radius of swing circle.
S. Swing circle of "sweet spot" on club face.

TERMINOLOGY

Front, Back, Left, Right—these terms are in relation to the robot as if it were a human, having right, left, front, and back sides relative to the direction it is facing.

DETAILED DESCRIPTION

Figure 2:
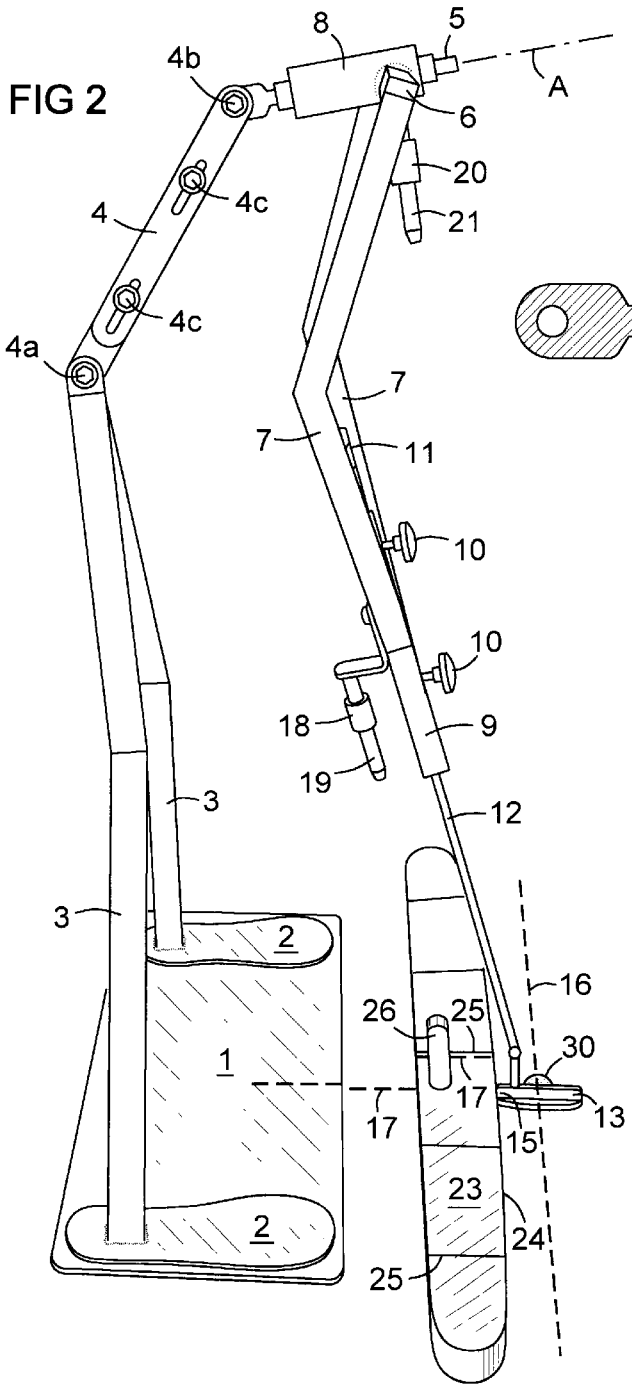
FIG. 2 is a side view of the robot with the arms centered.

FIGS. 1 and 2 show front and side views respectively of a mechanical human figure according to the present invention. Two feet 2 are fixed to two legs 3, which converge upward to an attachment bolt 4*a* for a spine 4 that projects upward and forward from the attachment bolt. The spine attachment bolt provides a forward angle adjustment for the spine. Preferably the spine provides length adjustment. For example the spine can be formed of overlapping flat bars fixed together with bolts 4*c* in elongated slots in the bars, as shown. The top of the spine has an attachment bolt 4*b* for a shaft 5 that projects upward and forward from the top of the spine. The shaft attachment bolt provides a forward angle adjustment for the shaft. The shaft provides a pivot axle for a pivoting assembly of shoulders 6 and arms 7. The arms are fixed relative to the shoulders.

Figure 3:
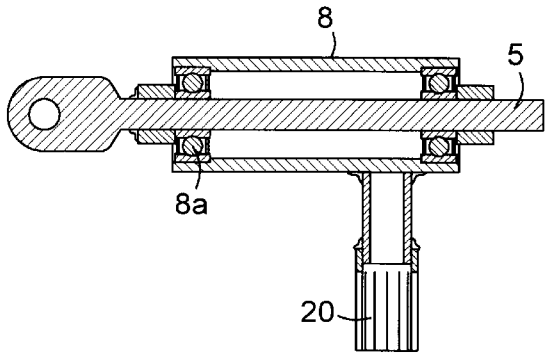
FIG. 3 is an enlarged side sectional view of the pivot assembly.

This describes a mechanical human figure with a stationary lower assembly of feet, legs and spine, and with an upper assembly of shoulders and arms that pivots on a shaft projecting forward from the top of the spine. The shoulders are attached centrally to a pivot bearing assembly 8 that is mounted on the pivot shaft 5. The pivot bearing assembly preferably has one or more low friction bearings as shown in FIG. 3.

The arms 7 converge downward from the shoulders 6 to a mechanism 9–10 for holding a golf club 11–15. For example a tube 9 as shown can be fixed to the lower ends of the arms to serve as mechanical hands for holding the club. Two clamping screws with knobs 10 can be threaded into the tube to hold the golf club grip 11 in a selected position.

A golf putting club is fixed in the holding mechanism 9. The club has a grip 11, a shaft 12, and a head 13 with a generally planar face 14 and a heel 15. The club is mounted so that the head just clears the ground when the holding mechanism is centered laterally in front of the robot. The club face has a "sweet spot", which is the best contact point on the face for striking a golf ball. The club head moves in a circular swing arc that is approximately tangent to the ground. The "sweet spot" on the club face will move in a circular swing arc about the pivot axis A, defining a swing plane. The spine and pivot shaft angles of the robot are adjusted so that the golf head is positioned at a desired putting distance in front of the robot.

Two laser beam sources are attached to the robot. A first laser source 19 is preferably attached to the back of the club holding mechanism 9 to project a planar laser beam downward in the plane of the golf club face. This illuminates the alignment of the club face throughout the stroke, and demonstrates the use of club face alignment lines on a golf putting guide as later described. A second laser source 21 is preferably attached to the forward end of the pivot assembly 8 to project a planar beam downward in the swing plane, illuminating the ball-target line and demonstrating the stability of the swing plane throughout the stroke.

Figure 6:
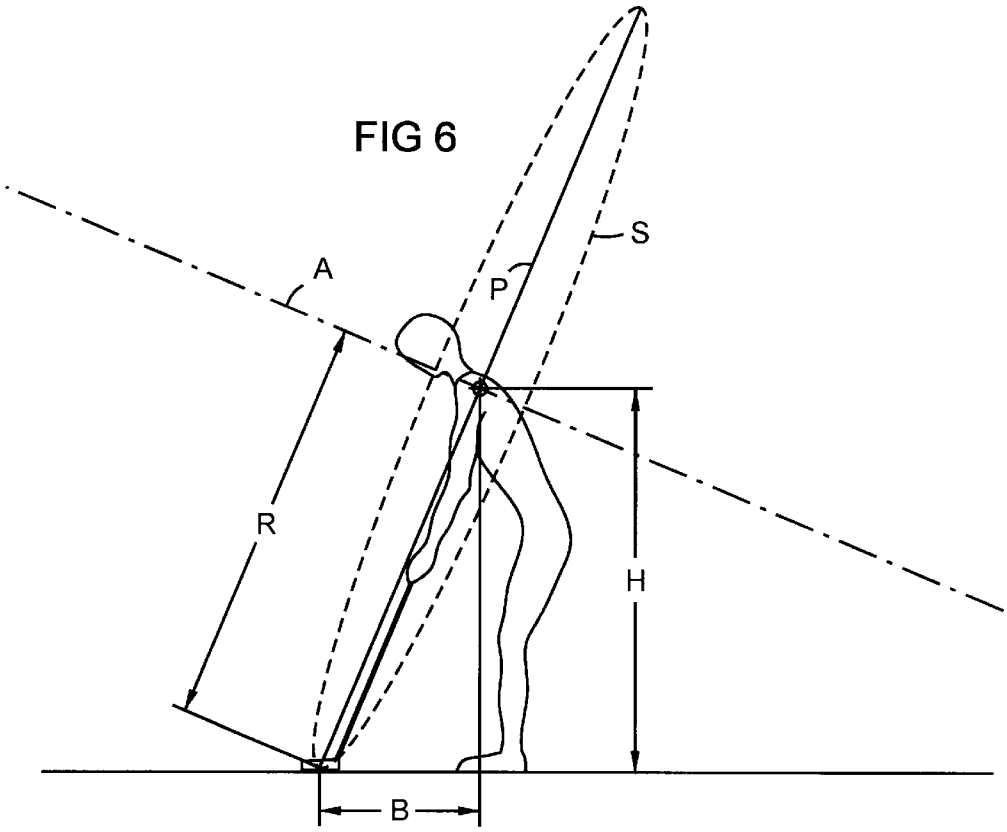
FIG. 6 is a side view of a golfer showing the geometric parameters used in the golf stroke guide and robotic demonstration method.
Figure 7:
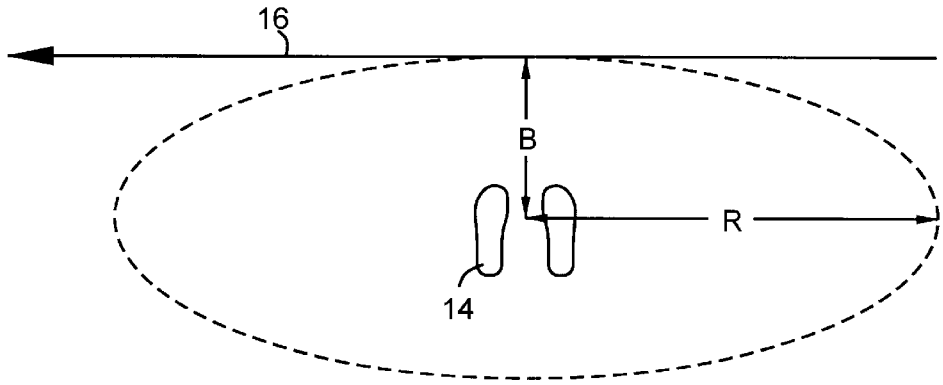
FIG. 7 is a top view of the projection of the swing circle on the ground, which is an ellipse used in the design of the golf stroke guide.

The robot is designed to demonstrate a golf putting stroke guide as disclosed in the related patent application. An example of this putting guide is shown in FIGS. 1, 2, 4, and 5 of the present application. It has a vertical guide surface 24, along which the heel 15 of a golf club is guided in a circular swing arc centered between the shoulders of the robot or a person using the guide. The guide surface preferably has an elliptical shape when viewed from above, which is the downward projection of the swing circle on the ground as shown in FIGS. 6 and 7. The guide surface has the form of a vertical extrusion of a portion of an ellipse defined by the equation $$Y=\pm B/R\sqrt{R^2-X^2}$$

where the ellipse is in a horizontal plane using an x, y coordinate system whose origin is the geometric center of the ellipse, the x direction is positive to the right and the y direction is positive forward relative to the robot or a person using the putting guide, B is the horizontal distance from the center of the swing circle to the "sweet spot" on the club face, and R is the radius of the swing circle.

The golf putting guide has club face alignment marks 25 that extend horizontally back from the guide surface perpendicular to an imaginary horizontal line tangent to the guide surface at its point of intersection with the alignment mark. These alignment marks provide visual guidance for the angle of the club face at selected intervals along the stroke. Following this guidance the club head has no secondary rotation in a golfer's hands, but simply pivots with the club in the swing circle. This simplifies the stoke motion for maximum control and consistency.

Figure 4:
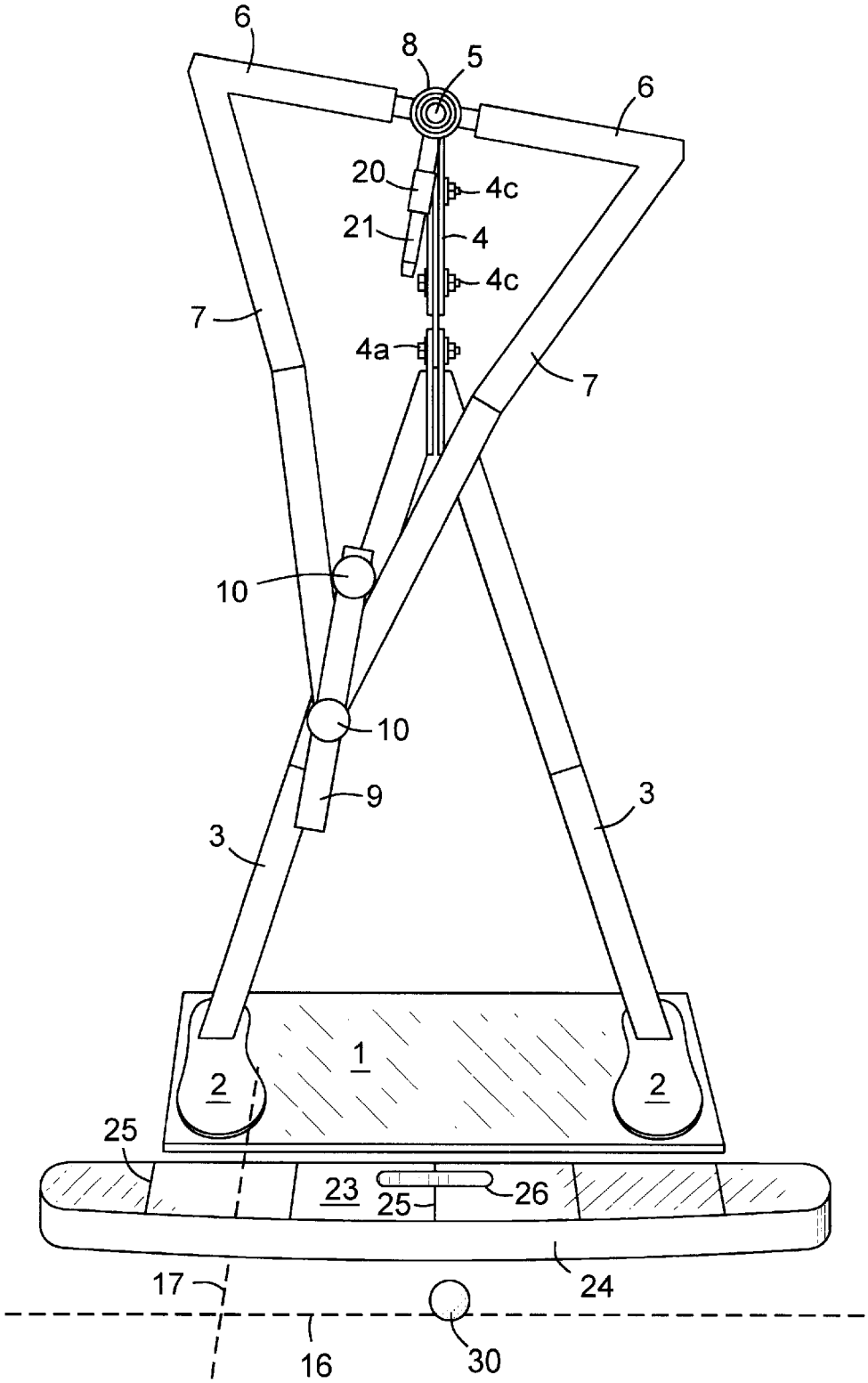
FIG. 4 is a front view as in FIG. 1 with the club removed to show the club face alignment line 17 that is illuminated by the first laser.
Figure 5:
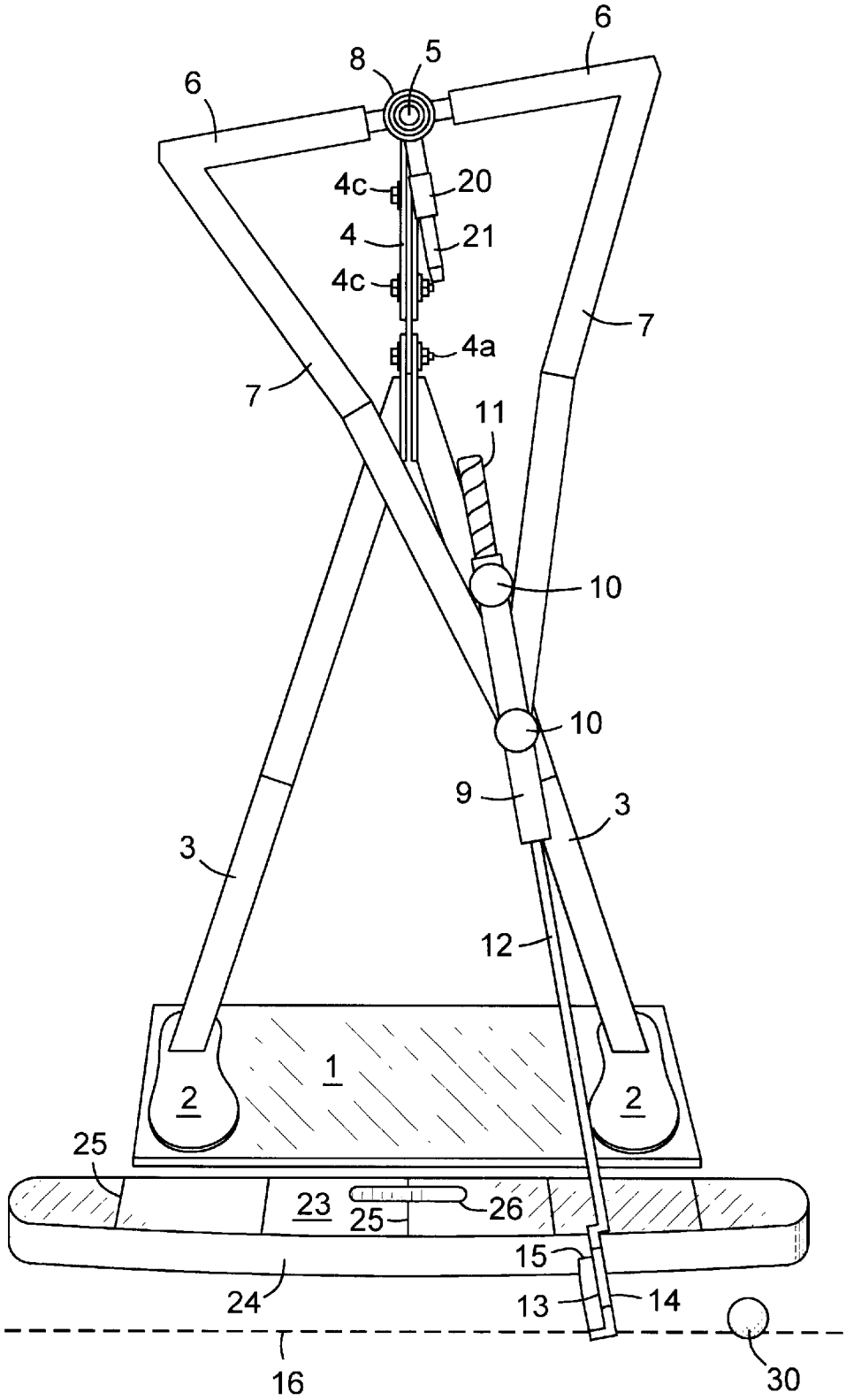
FIG. 5 is a front view of the robot in a follow-through position.

The club is mounted in the robot club holder with the club face normal to the ball-target line. The club cannot rotate in the holder, so it maintains perfect alignment at all points of a stroke. The first laser source 19 illuminates the intersection of the plane of the club face with the ground as a line 17. More importantly, it illuminates this plane on the putting Guide, as shown in FIGS. 2 and 4. Thus, line 17 coincides with each alignment mark 25 as the club passes each alignment mark. This demonstrates the concept of club face alignment using these marks on the guide.

The robot is preferably adjustable as previously described so that the swing circle height and angle can be adjusted to match the dimensions of any golfer within a range of normal human proportions. This allows the robot to accurately demonstrate the golf putting guide as provided in a range of sizes for golfers of various sizes.

The lasers can be rotated in their holders for adjustment. They are adjusted once initially so that the second laser 21 projects a planar beam in the swing plane, and the first laser 19 projects a planar beam normal to the swing plane and laterally centered relative to the robot when the arms are centered.

In operation, a golf putting guide designed according to the above description is selected for demonstration. The robot spine angle, length, and shaft angle are adjusted as necessary to provide a swing circle with the design parameters B and R used in the selected guide. A putting club is mounted and adjusted in the holder so that the club face coincides with laser line 17, and laser line 16 intersects the "sweet spot" of the club face, and the club head just clears the ground. A golf ball is placed on laser line 16 touching the club face. The putting guide 23 is placed in front of the robot as shown. It is positioned so that the central alignment line 25 on the guide coincides with laser line 17, and the back of the guide is parallel to line 16, and the guide surface 24 just clears the heel of the club. The arms are then manually rotated to the right in a putting backswing position, with the club head near the right side of the guide. The arms are then released to fall in a pendulum motion by gravity, and the club face strikes the ball. The arms follow-through on the left side of the guide, then oscillate back while the ball moves along the target line 16. A slow-motion demonstration can be made by manually moving the arms to clearly show and describe the coincidence of laser line 17 with the club face alignment marks on the guide.

It has been found that this robot gives an ideal demonstration of the golf putting guide when adjusted as described. The heel of the golf club just grazes the guide surface throughout the stroke, laser line 17 coincides with each alignment mark as it passes them, laser line 16 illuminates the ball-target line throughout the stroke, and the ball consistently follows the ball-target line to a target, producing consistently perfect putts.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A golf stroke demonstration robot in the form of a mechanical human figure standing in a golf putting posture on a horizontal surface, comprising:

a lower stationary assembly of feet, legs, and a spine having a top end;

an upper pivoting assembly of shoulders and arms, the arms having lower ends attached to a golf club holder;

the upper assembly rotationally attached to the lower assembly on a pivot axle extending forward and upward from the top of the spine between the shoulders, the upper assembly having a pivot axis;

a first laser source on the upper assembly that projects a planar laser beam downward in a plane normal to the pivot axis; and a second laser source on the upper assembly that projects a planar laser beam downward in a plane including the pivot axis and passing through the club holder.

2. The golf stroke demonstration robot of claim 1 in combination with a golf stroke training guide on the horizontal surface in front of the robot, the guide having a vertical guide surface in the form of a vertical extrusion of an arc; a top surface attached to the guide surface; and a series of club face alignment marks on the top surface, each of which is a line perpendicular to an imaginary horizontal line tangent to the guide surface at the intersection of the alignment mark with the guide surface.

3. The golf stroke training device of claim 2, further comprising:

a golf club mounted in the holder;

a head on the club with a ball-striking point that moves with the upper assembly, describing a circular arc about the pivot axis; and wherein the vertical guide surface has the form of a vertical extrusion of a portion of an ellipse defined by the equation $$Y=\pm B/R\sqrt{R^2-X^2}$$

where the ellipse is in a horizontal plane using an x, y coordinate system whose origin is the geometric center of the ellipse, the x direction is positive to the right and the y direction is positive forward relative to the robot, B is the horizontal distance from the center of the circular arc to a golf ball on the horizontal surface to be struck by the ball-striking point, and R is the radius of the circular arc.

4. A golf stroke demonstration robot in the form of a mechanical human figure standing in a golf putting posture on a horizontal surface, comprising:

a lower stationary assembly comprising two feet attached to two legs, the two legs having upper ends attached to a spine having a top end;

an upper pivoting assembly comprising two arms attached to two shoulders, the two shoulders joined to a pivot assembly between them, each arm having a distal end, the two arms converging downward from the shoulders to the distal ends;

a golf club holder attached to the two distal ends of the arms;

a golf club with a grip mounted in the golf club holder in a golf putting position, the golf club having a lower end with a head, the head having a heel and a generally planar ball-striking face with an optimum ball-striking point;

the upper assembly attached to the lower assembly on a pivot axle extending forward and upward from the top of the spine between the shoulders into the pivot assembly such that the club head pivots about the axle in a circle tangent to the ground, and the ball-striking point follows a circular path in a swing plane;

the ball-striking face plane approximately normal to the swing plane;

a first laser source attached to the upper assembly that projects a planar laser beam toward the horizontal surface in the plane of the club face, illuminating a first line on the horizontal surface that indicates the club face alignment;

the robot having a front, a left, and a right side.

5. The golf stroke demonstration robot of claim 4, further comprising a second laser source attached to the upper assembly that projects a planar laser beam toward the horizontal surface in the swing plane, illuminating a second line on the horizontal surface that indicates a ball-target line.

6. The golf stroke demonstration robot of claim 4 in combination with a golf stroke training guide on the horizontal surface in front of the robot having a vertical guide surface in the form of a vertical extrusion of an arc, that guides the heel of the golf club along a desired path; a top surface attached to the guide surface; and a series of ball-striking face alignment marks on the top surface, each of which is a line perpendicular to an imaginary horizontal line tangent to the guide surface at the intersection of the alignment mark with the guide surface.

7. The golf stroke training device of claim 6, wherein the vertical guide surface has the form of a vertical extrusion of a portion of an ellipse according to the equation $$Y=\pm B/R\sqrt{R^2-X^2}$$

where the ellipse is in a horizontal plane using an x, y coordinate system whose origin is the geometric center of the ellipse, the x direction is positive to the right and the y direction is positive forward relative to the robot, B is the horizontal distance from the center of the circular path to a golf ball on the horizontal surface to be struck by the ball-striking point, and R is the radius of the circular path.

* * * * *